US007435066B2

(12) United States Patent
Enzaka et al.

(10) Patent No.: US 7,435,066 B2
(45) Date of Patent: Oct. 14, 2008

(54) OIL PUMP

(75) Inventors: Kazuo Enzaka, Gunma-ken (JP); Yasunori Ono, Gunma-ken (JP); Sentaro Nishioka, Gunma-ken (JP); Masahiro Kasahara, Gunma-ken (JP); Atsushi Kaneko, Gunma-ken (JP)

(73) Assignee: Yamada Manufacturing Co., Ltd., Kiryu-shi (JP)

( * ) Notice: Subject to any disclaimer, the term of this patent is extended or adjusted under 35 U.S.C. 154(b) by 76 days.

(21) Appl. No.: 11/385,665

(22) Filed: Mar. 22, 2006

(65) Prior Publication Data

US 2006/0216187 A1 Sep. 28, 2006

(30) Foreign Application Priority Data

Mar. 23, 2005 (JP) ..... 2005-084987

(51) Int. Cl.
*F01C 1/02* (2006.01)
*F01C 1/063* (2006.01)

(52) U.S. Cl. ..... 418/61.3; 418/58; 418/61.1

(58) Field of Classification Search ..... None
See application file for complete search history.

(56) References Cited

U.S. PATENT DOCUMENTS 4,767,296 A * 8/1988 Satomoto et al. ..... 418/171
5,145,347 A * 9/1992 Freeman ..... 418/77
5,413,470 A * 5/1995 Eisenmann ..... 418/171
5,466,137 A * 11/1995 Bierlein et al. ..... 418/75
5,516,268 A * 5/1996 Kassen et al. ..... 418/61.3
6,544,021 B2 * 4/2003 Watanabe et al. ..... 418/171
7,165,955 B2 * 1/2007 Enzaka et al. ..... 418/171

FOREIGN PATENT DOCUMENTS

JP 61-138893 6/1986
JP 04-005476 1/1992
JP 2842450 10/1998

OTHER PUBLICATIONS

European Search Report dated Aug. 7, 2007.

* cited by examiner

*Primary Examiner*—Thomas Denion
*Assistant Examiner*—Douglas J. Duff
(74) *Attorney, Agent, or Firm*—McGinn IP Law Group, PLLC

(57) ABSTRACT

The present invention provides an oil pump in which eroding of the inside of the pump due to cavitation and erosion is prevented by minimizing the pressure change in a fluid when inter-tooth spaces formed by an inner rotor and an outer rotor transport the fluid from the intake port to the discharge port. The oil pump comprises: an inner rotor; an outer rotor; an intake port; a discharge port; a transfer side partition part formed between a terminal end of the intake port and a leading end of the discharge port; and a shallow groove which is formed in the transfer side partition part, and which communicates with the discharge port but does not communicate with the intake port. The shallow groove does not intersect with the cell on the transfer side partition part, and is positioned farther inward than the circular locus of the gear bottom parts of the inner rotor. The shallow groove communicates with the cell through a side clearance between the transfer side partition part and the rotor side surfaces of the inner rotor and the outer rotor.

9 Claims, 11 Drawing Sheets

Fig.10A
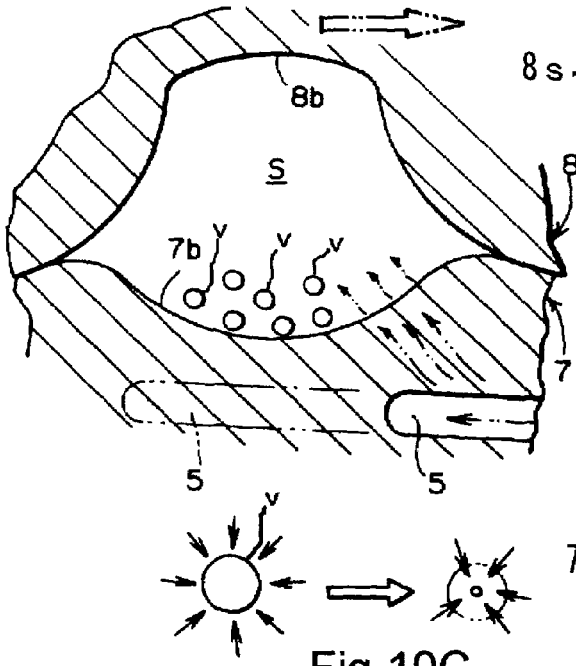
Fig.10B
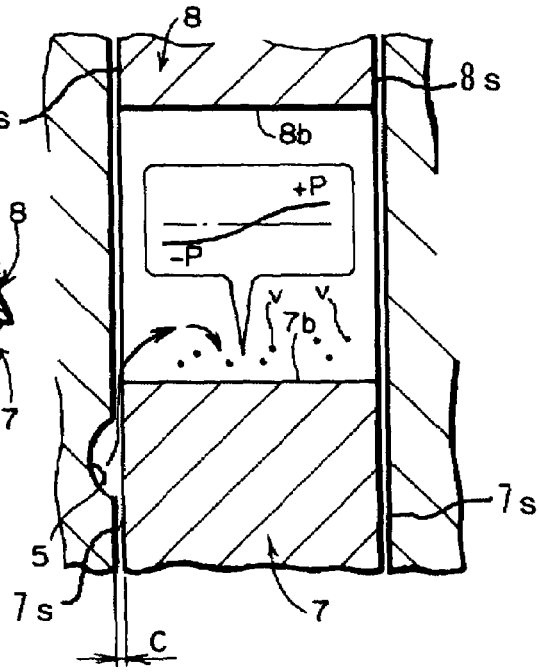
Fig.10C

Fig.11A
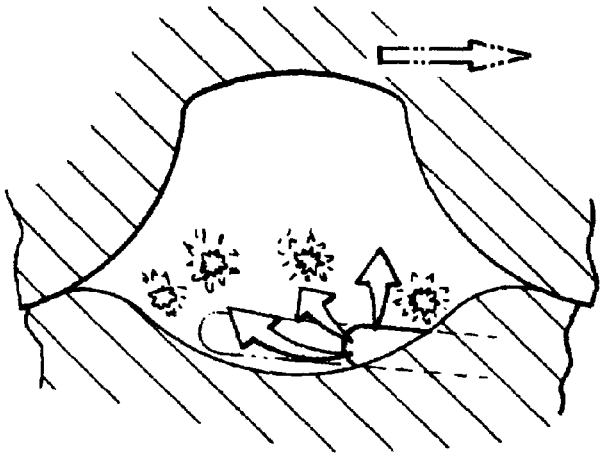
Fig.11B
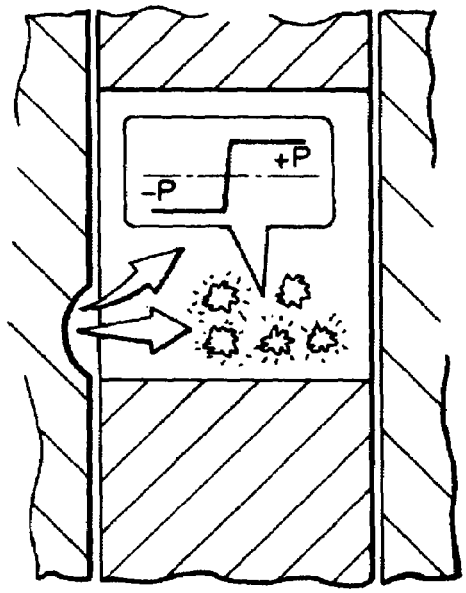
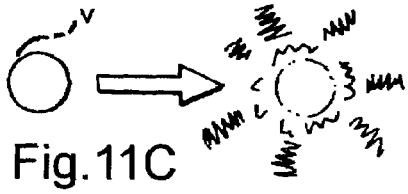
Fig.11C

OIL PUMP

BACKGROUND OF THE INVENTION

1. Field of the Invention

The present invention relates to an oil pump which is an internal contact gear pump, wherein each inter-tooth space formed by an inner rotor and an outer rotor transports a fluid from an intake port to a discharge port while minimizing and smoothing the change in pressure of the fluid enclosed in the inter-tooth space and preventing eroding of the inside of the pump due to cavitation and erosion, while having an extremely simple construction.

2. Description of the Related Art

There many types of pumps with inter-tooth chambers formed by an inner rotor and outer rotor equipped with trochoidal teeth, which discharge a fluid from a discharge port by moving the inter-tooth chamber filled with fluid from an intake port with a maximum volume condition to a reduced volume stroke. With these pumps, when the inter-tooth chamber carries fluid from an intake port to a discharge port, the volume of the inter-tooth chamber, which has a trochoidal tooth structure, will gradually change. In other words, the volume of the inter-tooth space will increase and decrease while moving from the intake port to the discharge port, so the pressure of the fluid in the inter-tooth chamber will vary.

Furthermore, when the inter-tooth chamber reaches the discharge port, the fluid enclosed at high pressure in the inter-tooth chamber will abruptly enter the discharge port, causing loud and unusual noises. In order to prevent the fluid from abruptly flowing into the discharge port in this manner, a pump with a small port formed on the discharge port side has been disclosed in U.S. Pat. No. 2,842,450. This small port is a shallow groove formed from the leading edge of the discharge port to the intake port side.

Therefore, a small amount of the high-pressure fluid in the inter-tooth chamber will be discharged into the discharge port through the small port before the inter-tooth chamber reaches the discharge port, because the inter-tooth chamber intersects with the small port and communicates with the discharge port through the small port. Therefore when the inter-tooth chamber reaches the discharge port, the fluid in the inter-tooth chamber will not abruptly flow into the discharge port, and pump noise can be prevented.

According to the referenced patent (U.S. Pat. No. 2,842,450), the high-pressure fluid in the inter-tooth chamber which moves from the intake port to the discharge port is prevented from abruptly flowing into the discharge port and the generation of large noise can be prevented. However, as described above, the inter-tooth chamber increases and decreases in volume during the process of moving the fluid from the intake port to the discharge port, and the pressure of the fluid enclosed inside will vary. This change in fluid pressure causes cavitation where vapor bubbles are formed in the fluid. The vapor bubbles created by cavitation will congregate on the gear bottom side on the inner rotor side of the inter-tooth chamber.

Furthermore, the small port disclosed in the referenced patent (U.S. Pat. No. 2,842,450) will directly intersect with the inter-tooth chamber which moves toward the discharge port side, and at the moment when communicated with the inter-tooth chamber, pressure variation will occur at the small port, and there is a possibility that the vapor bubbles collected at the gear bottom parts of the inner rotor will abruptly collapse (destruct). At this time, the small port will not be able to accommodate the change in hydraulic pressure, and there is a possibility of erosion where the vapor bubbles caused by cavitation will abruptly collapse (destruct).

Because of this erosion phenomenon, the momentary generation and collapse (destruct) of a plurality of vapor bubbles will cause impact scarring on the inner rotor, outer rotor, and housing or the like, the pump efficiency will be negatively affected, and maintaining a predetermined pump performance will be difficult. In other words, even though the fluid which is in the inter-tooth chamber which transports the fluid to the discharge port can be prevented from abruptly flowing into the discharge port, eroding cannot be prevented, and there is a possibility that erosion will occur.

SUMMARY OF THE INVENTION

An object of the present invention is to provide a simple construction which can suppress erosion by controlling sudden pressure variation inside the inter-tooth chamber which transports fluid from the intake port to the discharge port.

The invention of claim 1 resolves these problems using an oil pump, comprising: an inner rotor; an outer rotor which rotates with the inner rotor while forming a cell; an intake port; a discharge port; a transfer side partition part formed between the terminal end of the intake port and the leading end of the discharge port; and a shallow groove which is formed in the transfer side partition part, and which does not communicate with the intake port but communicates with the discharge port, wherein the shallow groove does not intersect with the cell on the transfer side partition part and is positioned toward the inside of the circular locus of the gear bottom parts of the inner rotor, a side clearance is established between the transfer side partition part and the rotor side surfaces of the inner rotor and the outer rotor, and the shallow groove communicates with the cell through this side clearance.

The invention of claim 2 resolves these problems using an oil pump with the aforementioned construction, wherein a gap of approximately 1 mm or less is established between the outside edge of the shallow groove in the groove width direction and the circular locus of the gear bottom parts formed by the rotation of the inner rotor. The invention of claim 3 resolves these problems using an oil pump with the aforementioned construction, wherein, in the transport side partition part, an outer shallow groove is formed positioned farther to the outside, from the center of rotation of the inner rotor, than the location where the shallow groove is formed, with the outer shallow groove communicating with the discharge port while not communicating with the intake port, and wherein the outer shallow groove communicates and intersects with the cell.

The invention of claim 4 resolves these problems using an oil pump with the aforementioned construction, wherein the length of the outer shallow groove in the longitudinal direction is formed to be shorter than that of the shallow groove. The invention of claim 5 resolves these problems using an oil pump with the aforementioned construction wherein the transport side partition part in which the shallow groove is formed is established on both sides of the inner rotor and the outer rotor.

With the invention of claim 1, the inside of the cell which moves along the transfer side partition part from the intake port to the discharge port is communicated with the shallow groove through the side clearance. Furthermore, the volume of the cell will increase by the process where the cell moves along the transfer side partition part from the intake port to the discharge port, the fluid pressure will drop, and vapor bubbles will occur because of cavitation. At this time, the flow of fluid into the cell will be very slow and gradual because the fluid is supplemented through the side clearance from the shallow groove, and therefore the pressure in the cell will gradually and smoothly rise, so the vapor bubbles generated will not abruptly collapse (destruct), but rather the vapor bubbles can be gradually eliminated by the smoothly increasing pressure. In this manner, vapor bubbles formed by cavitation will not abruptly collapse (destruct) because of the change in pressure, erosion will be prevented, and therefore the durability of the pump can be increased and pump life extended.

With the invention of claim 2, the flow of fluid from the shallow groove to the cell will be favorable, and the fluid in the cell can easily be supplemented because of the gap between the outside edge of the shallow groove in the groove width direction and the circular locus of the gear bottom parts formed by the rotation of the inner rotor, is approximately 1 mm or less. With the invention of claim 3, an outer shallow groove is established in addition to the shallow groove, so vapor bubbles which occur in the fluid in the cell can more positively be eliminated.

With the invention of claim 4, the pressure variation caused by the shallow groove can be minimized and vapor bubbles which occur can be eliminated during the initial movement phase to the middle movement phase of the cell along the transfer side partition part, and extremely good pump performance can be obtained because the fluid will be gradually discharged to the discharge port side through the outer shallow groove, from the final movement phase of the cell. Next, with the invention of claim 5, the supplementary fluid can relatively rapidly flow with good balance into the cell, vapor bubbles can be eliminated, and stable pump performance can be achieved because of the shallow grooves on both sides and the side clearance to both sides of the transfer side partition part.

BRIEF DESCRIPTION OF THE DRAWINGS

FIG. 10A is a rough cross-section sketch showing the positional relationship between the cell and the shallow groove for the present invention, FIG. 10B is a major component longitudinal side cross-section diagram of the cell and shallow groove, and FIG. 10C is a diagram showing the condition where the vapor bubbles are being eliminated; and FIG. 11A is a rough cross-section sketch showing the positional relationship between the cell and the shallow groove for the conventional technology, FIG. 11B is a major component longitudinal side cross-section diagram of the cell and shallow groove, and FIG. 11C is a diagram showing the condition where the vapor bubbles are collapsing (destruction).

DESCRIPTION OF THE PREFERRED EMBODIMENTS

Figure 1A:
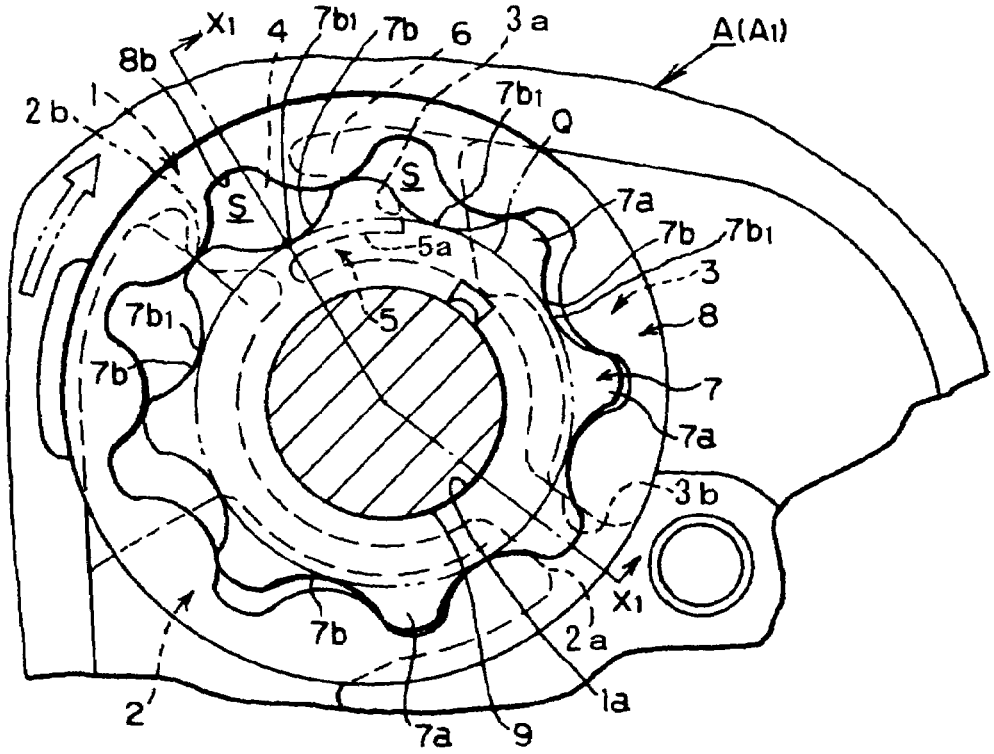
FIG. 1A is a top view diagram of an embodiment of the present invention.
Figure 2A:
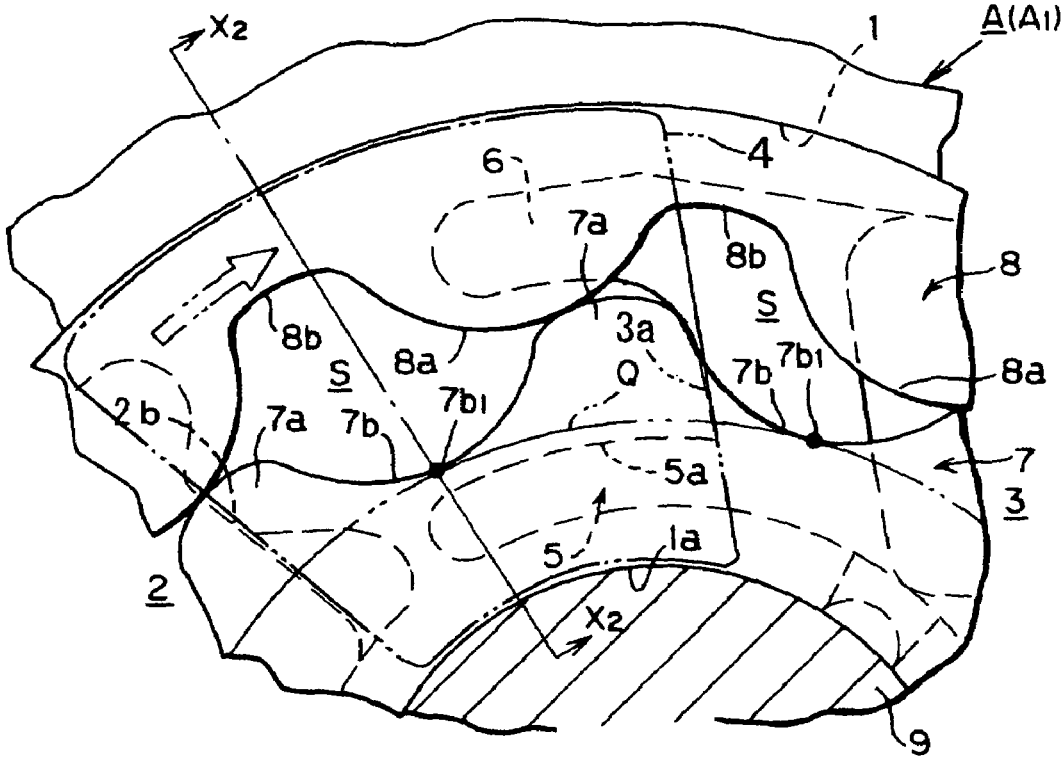
FIG. 2A is an expanded top view diagram of the major components of the present invention.

Preferred embodiments of the present invention will be described below based on the drawings. As shown in FIG. 1A, the oil pump of the present invention contains an inner rotor 7 and an outer rotor 8 with trochoidal teeth in a rotor chamber 1 formed in a housing A. FIG. 2 is a front view drawing of the main components of the housing body $A_1$ of the housing A, and as shown in FIG. 2A, an intake port 2 and a discharge port 3 are formed in the rotor chamber near the outer circumference in the circumferential direction thereof. The intake port 2 and the discharge port 3 are asymmetrically formed on the left and right of the rotor chamber 1. Alternatively, the intake port 2 and the discharge port 3 may be formed with left and right symmetry.

As shown in FIG. 1A, the inner rotor 7 has one fewer tooth than the outer rotor 8, creating a relationship where when the inner rotor 7 makes one rotation, the rotation of the outer rotor 8 will be delayed. Therefore, the inner rotor 7 will have teeth 7*a* which protrude outward and gear bottom parts 7*b* which are recessed inward, and similarly, the outer rotor 8 will have protruding teeth 8*a* and recessed gear bottom parts 8*b* closer to the center side than the inner circumferential side. Inter-tooth spaces are formed by the combination of these teeth 7*a*, 8*a* and these gear bottom parts 7*b*, 8*b* by the rotation of the inner rotor 7 and the outer rotor 8, and these inter-tooth spaces are referred to as cells S.

In the intake port 2, the edge of the intake port 2 where the cell S formed by the rotation of the inner rotor 7 and the outer rotor 8 moves and first reaches the intake port 2 is referred to as the leading edge 2*a* of the intake port 2, and the edge where the cell S leaves the intake port 2 because of rotation is referred to as the terminal end 2*b* of the intake port 2. Similarly, in the discharge port 3, the edge of the discharge port 3 where the cell S formed by the rotation of the inner rotor 7 and the outer rotor 8 moves and first reaches the discharge port 3 is referred to as the leading edge 3*a* of the discharge port 3, and the edge where the cell S leaves the discharge port 3 because of the rotation of the cell S is referred to as the terminal end 3*b* of the discharge port 3 (Refer to FIG. 3).

Figure 1B:
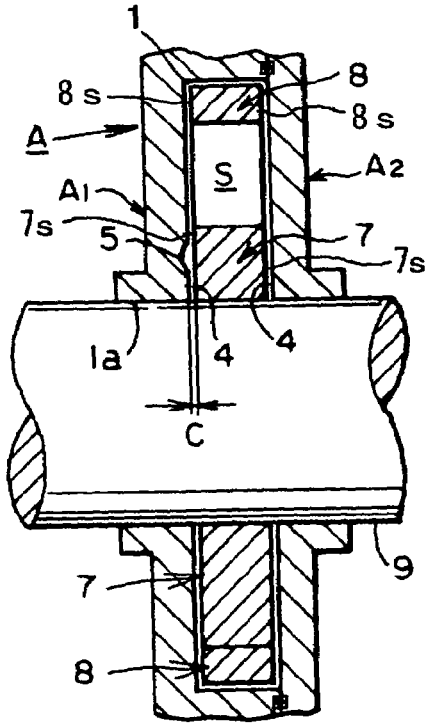
FIG. 1B is a cross-section view along the line $X_1$-$X_1$ in FIG. 1A.
Figure 3A:
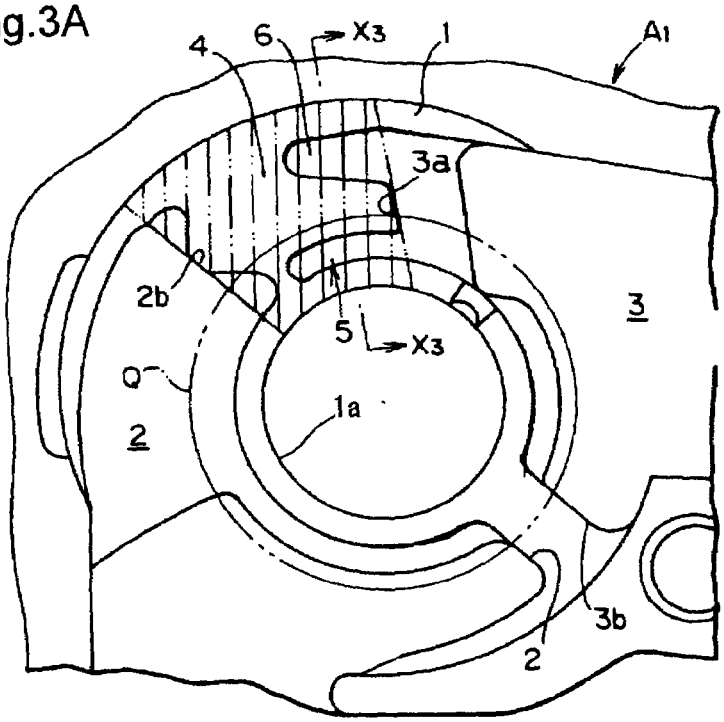
FIG. 3A is a top view diagram of the rotor chamber of the housing body.
Figure 3B:
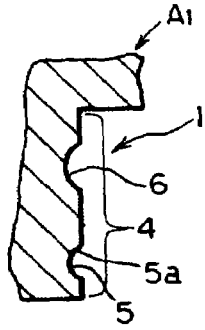
FIG. 3B is a cross-section view along line $X_3$-$X_3$ in FIG. 3A.
Figure 4:
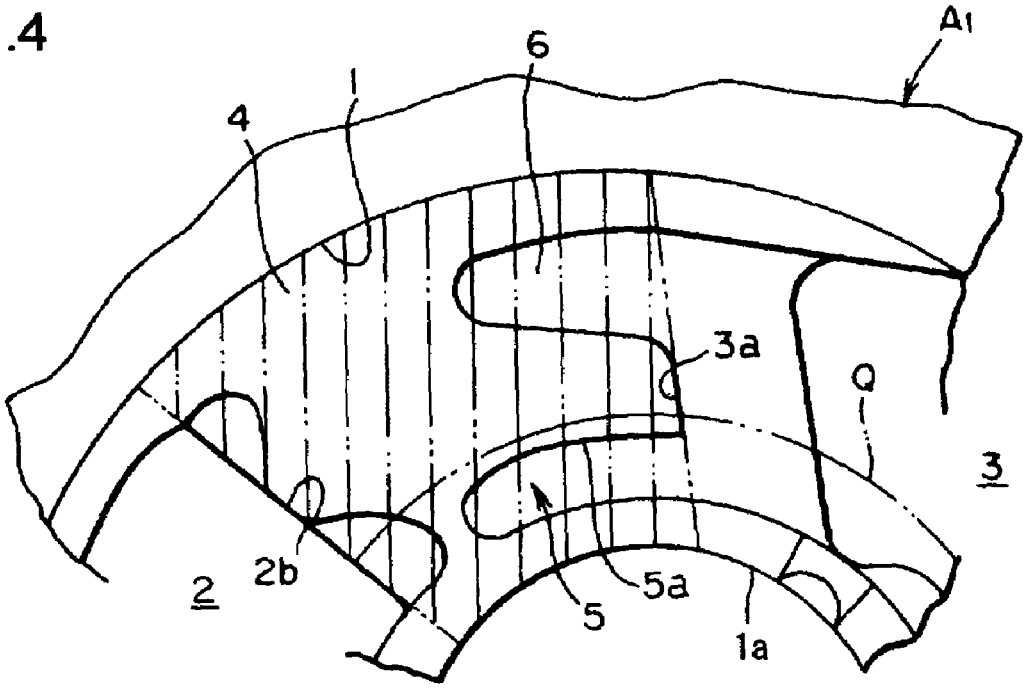
FIG. 4 is an expanded top view diagram of the transfer side partition part area of the housing body.

As shown in FIG. 2A, FIG. 3A, and FIG. 4, a transfer side partition part 4 is formed between the terminal end 2*b* of the intake port 2 and the leading edge 3*a* of the discharge port 3 in order to partition the intake port 2 and the discharge port 3. The transfer side partition part 4 is the region enclosed by the double dotted broken line in FIG. 2A, and the region shown by the double dotted broken line hatch marks in FIG. 3 and FIG. 4. The transfer side partition part 4 is formed to be a flat surface. Furthermore, the transfer side partition part 4 acts to form a closed chamber in the process where the fluid from the intake port 2 drawn into the cell S formed by the inner rotor 7 and the outer rotor 8 is transported to the discharge port 3 (Refer to FIG. 1B). Incidentally, the inner rotor 7 and the outer rotor 8 rotate in a clockwise direction. Furthermore, if the intake port 2 and the discharge port 3 are formed on the opposite left and right sides, the inner rotor 7 and the outer rotor 8 will rotate in a counterclockwise direction.

The housing A is comprising a housing body $A_1$ and a cover $A_2$, and a rotor chamber 1 is formed in the housing body $A_1$ (Refer to FIG. 3A). Furthermore, the transfer side partition parts 4 are formed on both sides of the housing body $A_1$ and the cover $A_2$ (Refer to FIG. 1B and FIG. 2B). Furthermore, the cell S formed by the inner rotor 7 and the outer rotor 8 contained in the rotor chamber 1 is enclosed in a near closed condition by both rotor side surfaces because of both of the transfer side partition parts 4, 4 (Refer to FIG. 1B and FIG. 2B).

A side clearance C is established between the rotor side surface 7*s* of the inner rotor 7 and the transfer side partition part 4. Furthermore, similarly a side clearance C may also be established between the rotor side surface 8*s* of the outer rotor 8 and the transfer side partition part 4. Herein, the rotor side surface 7*s* of the inner rotor 7 and the rotor side surface 8*s* of the outer rotor 8 are the surfaces perpendicular to the outer circumferential surface.

Therefore, if the inner rotor 7 and the outer rotor 8 are trochoidal tooth shaped rotors, then the outer circumferential surface of the inner rotor 7 will be the tooth surface and the inner circumferential surface of the outer rotor 8 will be the circumferential side surface. This side clearance C allows fluid to flow between the cell S located above the transfer side partition part 4 and the shallow groove 5 which will be discussed later. The width of this side clearance C is appropriately set by the width and depth or the like of the shallow groove 5 which will be discussed later, and each of these dimensions are not restricted.

Therefore, the clearance which is always between the rotor side surface 8*s* of the outer rotor 8 and the rotor side surface 7*s* of the inner rotor 7 and the inside of the housing A (housing body $A_1$ and cover $A_2$) in order to allow smooth rotation of the inner rotor 7 and the outer rotor 8 inside the rotor chamber 1 of the housing A may be used as this side clearance C. Furthermore, the side clearance C is a clearance with larger gap dimensions than a normal clearance.

In actuality, the difference between a normal clearance and a clearance with larger gap dimensions may be extremely minimal. Furthermore, the side clearance C allows fluid from the shallow groove 5 which will be discussed later, but only an extremely small quantity of fluid must gradually be set to the cell S. Therefore, a normal clearance that exists between the housing and the rotor in a standard pump with built-in rotor, is included in the side clearance C. This normal clearance is the clearance necessary for the rotor to rotate smoothly.

Next, as shown in FIG. 3 and FIG. 4 or the like, a shallow groove 5 is formed in the transfer side partition part 4. The shallow groove 5 is formed on the transfer side partition part 4 with a near linear or near stirated configuration extending from the leading edge 3*a* of the discharge port 3 to the terminal end 2*b* of the intake port 2. The shallow groove 5 is communicated with the discharge port 3, but is not communicated with the intake port 2. Furthermore, the shallow groove 5 is formed at a location inside of the circular locus Q formed by the gear bottom part points 7*b* when the inner rotor 7 is rotated, and the shallow groove 5 does not protrude outside of this circular locus Q. Furthermore, the shallow groove 5 is formed to be substantially parallel to the arc of the circular locus Q along the inside side of the circular locus Q (Refer to FIG. 2A, FIG. 3, FIG. 4 and the like).

Herein, the circular locus Q is defined as the circular locus for the movement of the deepest point $7b_1$ of the gear bottom parts 7*b* by the rotation of inner rotor 7 (Refer to FIG. 1A and FIG. 2A). Furthermore, the shallow groove 5 does not intersect with the cell S which moves the transfer side partition part 4 (Refer to FIG. 1 and FIG. 2). In other words, the shallow groove 5 does not enter into the region where the cell S is formed in the transfer side partition part 4. Incidentally, the center of the circular locus Q is the center of the boss hole 1*a* which axially supports the drive shaft 9 of the inner rotor 7. The boss hole 1*a* is formed in the housing A.

Figure 2B:
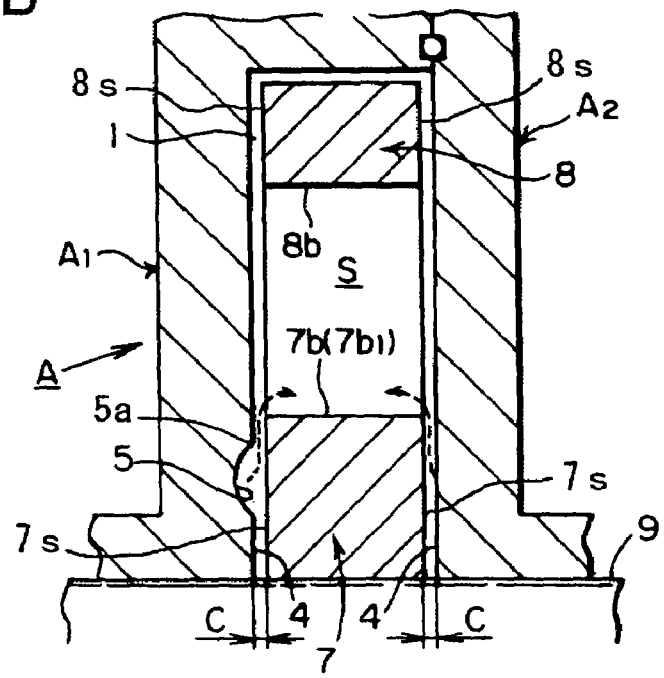
FIG. 2B is a cross-section view along line $X_2$-$X_2$ in FIG. 2A.

As previously stated and as shown in FIG. 2B, the cell S and the shallow groove 5 are communicated only by the side clearance C, and the fluid is able to flow from the shallow groove 5 through the side clearance C into the cell S. The outer edge 5*a* on the outside edge of the shallow groove 5 in the widthwise direction is formed on the inside of the circular locus Q close to the circular locus Q (Refer to FIG. 2A). Therefore, the outer edge 5*a* is formed along the longitudinal direction (direction from the leading edge 3*a* of the discharge port 3 to the terminal end 2*b* of the intake port 2) of the shallow groove 5, and the interval to the deepest point $7b_1$ of the gear bottom parts 7*b* of the inner rotor 7 is set to be extremely small.

Specifically, this interval is only a few millimeters, and preferably is less than approximately 1 mm. Therefore the gap dimension of the side clearance C is minimized, and for instance, normally even with a clearance of minimum gap width, the interval between the shallow groove 5 and the circular locus Q of the gear bottom parts of the inner rotor 7 which forms the cell S is extremely short, so fluid will reach the cell S relatively quickly and the fluid can be replenished.

Incidentally, the interval between the circular locus Q and the outer edge 5*a* in the widthwise direction of the shallow groove 5 is not restricted to the aforementioned values, and may be 1 mm or greater depending on the size of the inner rotor 7 and outer rotor 8 as well as the gap dimensions of the side clearance C, and these values may be set as appropriate. Furthermore, the shape of the shallow groove 5 in the longitudinal direction is formed to be a circular arc, but a linear shape is also acceptable. Furthermore, the shallow groove 5 may be formed by either a cutting operation or aluminum diecast forming.

The leading edge of the shallow groove 5 in the longitudinal direction is extremely close to the terminal end 2*b* of the intake port 2, and when the cell S reaches the transfer side partition part 4, the cell S communicates with the shallow groove 5 through the side clearance C from the initial condition where the side surface of the cell S is enclosed by the transfer side partition part 4. The side clearance C is the gap between the transfer side partition part 4 and the inner rotor 7 and the outer rotor 8, and this gap is extremely small, so the flow of fluid into the cell S from the side clearance C through the shallow groove 5 will be minimal. However, the fluid transported in the shallow groove 5 will flow substantially consistently and simultaneously into the cell S along the longitudinal direction of the shallow groove 5, and the pressure of the fluid in the cell S will smoothly rise to precisely the proper level (Refer to FIG. 5 and FIG. 6).

Furthermore, in the process where the cell S moves from the intake port 2 side to the discharge port 3 side on the transfer side partition part 4, fluid from the shallow groove 5 will gradually be transported in minute quantities to the cell S. Therefore, as the cell S moves along the transfer side partition part 4, fluid in the discharge port 3 will be replenished from the shallow groove 5 depending on the pressure of the fluid which changes pressure in conjunction with the increase or decrease in volume, and this replenishing will gradually transport a minute quantity of fluid, so the pressure rise will be smooth, the plurality of vapor bubbles v which are generated in the fluid will not abruptly collapse (destruct), but rather will gradually shrink and be eliminated.

Therefore, eroding can be prevented, and erosion to the housing A, inner rotor 7, and outer rotor 8 can be prevented. As previously mentioned, the cell S increases in volume and reaches maximum volume while moving the transfer side partition part 4 from the intake port 2 side to the discharge port 3 side, and then decreases in volume, but, through the shallow grove 5 and the side clearance C, fluid has been gradually flowing into and replenishing the cell S since the internal fluid inside the cell S became a negative pressure prior to reaching the maximum volume (Refer to FIG. 5).

Figure 9:
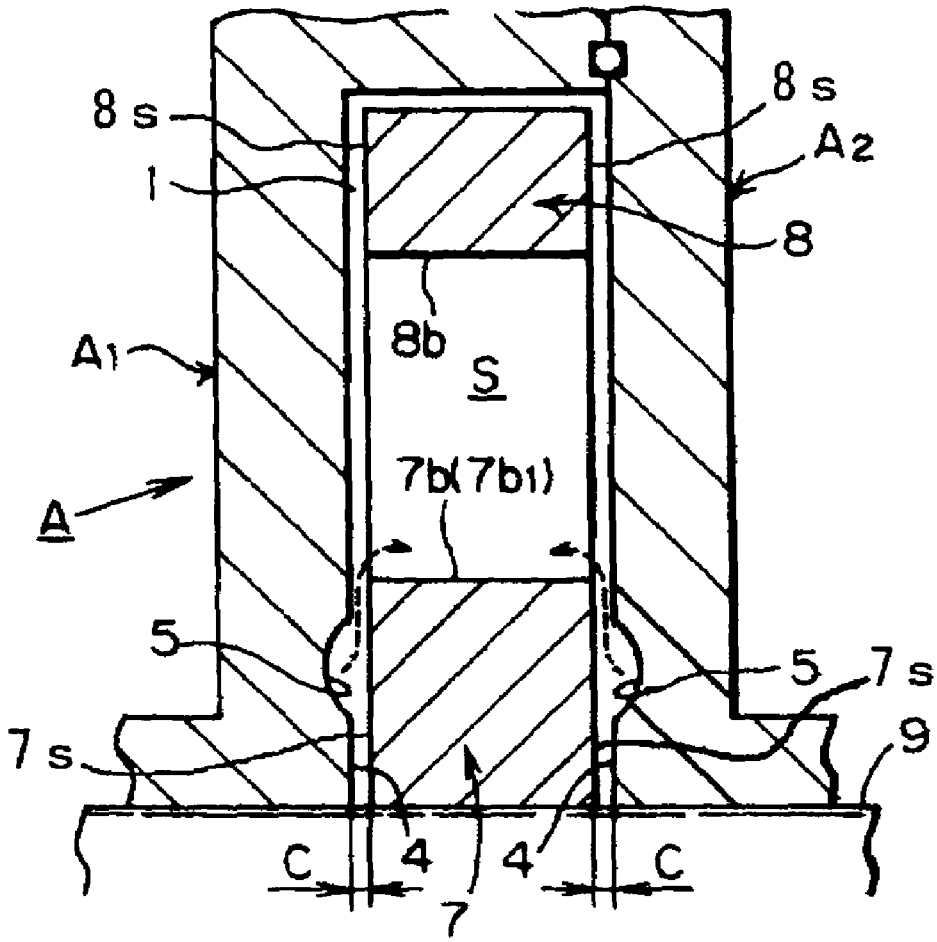
FIG. 9 is a longitudinal side cross-section view of the major components of an embodiment wherein the shallow groove is formed in the transfer side partition part on the cover side.

Incidentally, the shallow groove 5 is usually formed in the transfer side partition part 4 on the housing body $A_1$ side, but if necessary, a construction where the shallow groove 5 is also formed on the transfer side partition part 4 on the side where the cover $A_2$ is formed is also acceptable. In other words, shallow grooves 5, 5 may be formed on both transfer side partition parts 4, 4 which are formed on both the housing body $A_1$ side and the cover $A_2$ side, and therefore this construction will allow fluid to flow from both side surfaces of the cell S through both side clearances C, C and both shallow grooves 5, 5 (Refer to FIG. 9). Furthermore, it is also possible that a shallow groove 5 is not formed on the transfer side partition part 4 on the housing body $A_1$ side, but a shallow groove 5 is formed on the transfer side partition part 4 on the cover $A_2$ side.

Next, as shown in FIG. 3 and FIG. 4, an outer shallow groove 6 is formed in the transfer side partition part 4. The outer shallow groove 6 is formed on the transfer side partition part 4 to extend from the leading edge 3*a* of the intake port 3 to the terminal end 2*b* of the intake port 2. The outer shallow groove 6 is located farther from the rotational center of the inner rotor than the location where the shallow groove 5 is formed, and the outer groove 6 is communicated with the discharge port 3 but not communicated with the intake port 2. The outer groove 6, on the transfer side partition part, directly intersects and communicates with the region forming the cell S as the cell S approaches the discharge port 3 (Refer to FIG. 5C).

Furthermore, liquid is discharged from the outer groove 6 to the discharge port 3 as the volume of the cell S decreases as the cell S moves along the transfer side partition part 4 from the intake port 2 side to the discharge port 3 side, and the pressure of the fluid enclosed therein rises. Therefore, when the cell S reaches the discharge port 3, the fluid in the cell S will not abruptly flow into the discharge port 3.

Furthermore, the outer shallow groove 6 differs in length in the longitudinal direction towards the intake port 2 side as compared to the shallow groove 5, and is formed to be shorter than the longitudinal length of the shallow groove 5 (Refer to FIG. 1A, FIG. 3A, and FIG. 4). In other words, the shallow groove 5 and the outer shallow groove 6 are made to begin functioning at different times, and the construction is such that as the cell S moves along the transfer side partition part 4, the fluid will first flow from the shallow groove 5 through the side clearance C, and later the fluid in the cell S will gradually be discharged from the outer shallow groove 6.

Figure 5A:
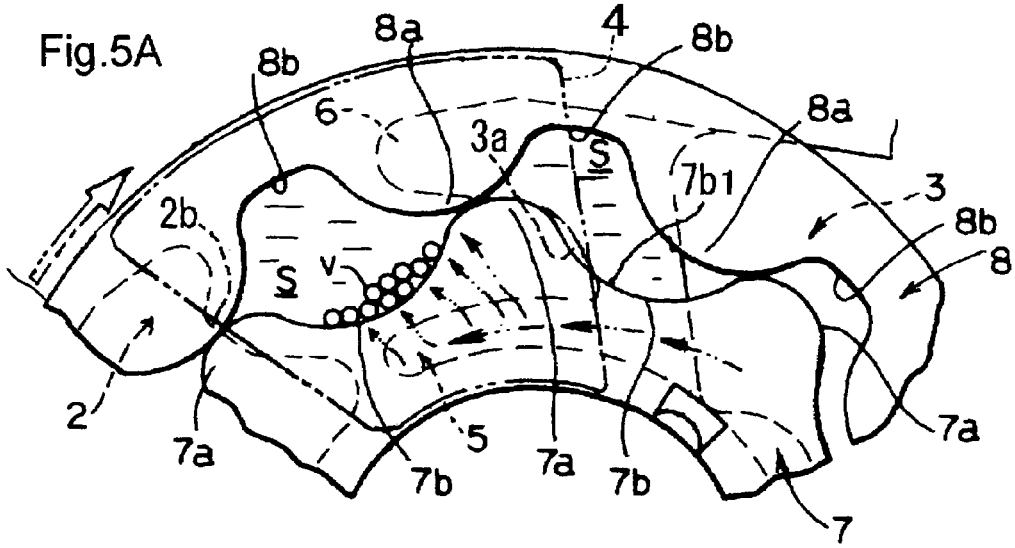
FIG. 5A is a diagram showing the condition where vapor bubbles occur in the cell in the transfer side partition part.
Figure 5B:
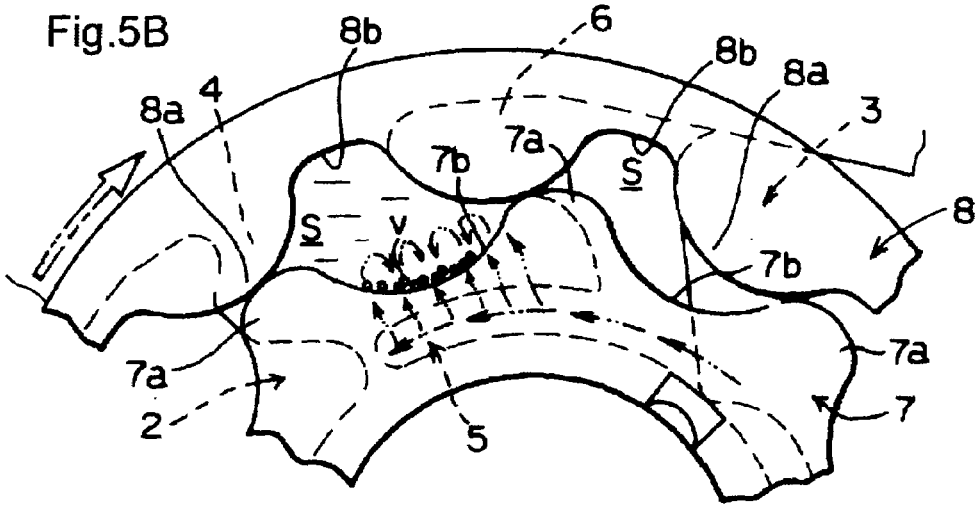
FIG. 5B is a diagram showing the condition where fluid flows into the cell from the shallow groove through the side clearance, decreasing the size of the vapor bubbles.
Figure 5C:
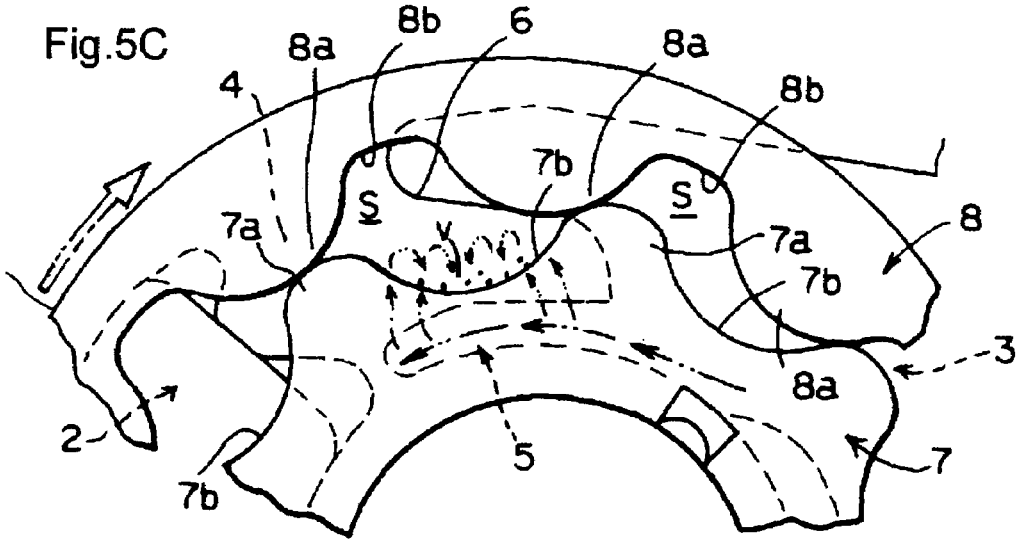
FIG. 5C is a diagram showing the condition where the vapor bubbles in the cell are eliminated.
Figure 6A:
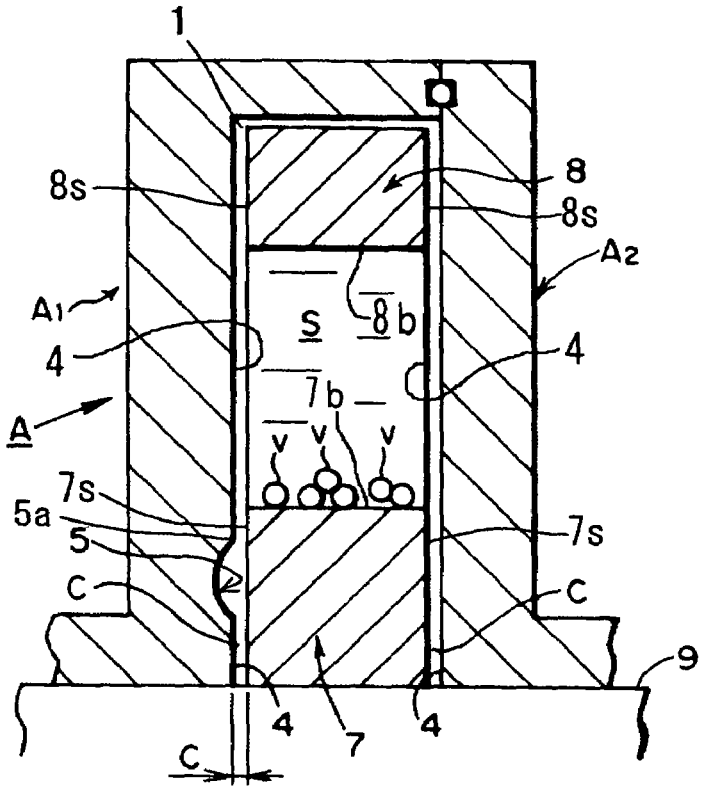
FIG. 6A is a major component longitudinal side cross-section view showing the condition where vapor bubbles form in the cell on the transfer side partition part, and where fluid flows into the cell from the shallow groove through the side clearance.
Figure 6B:
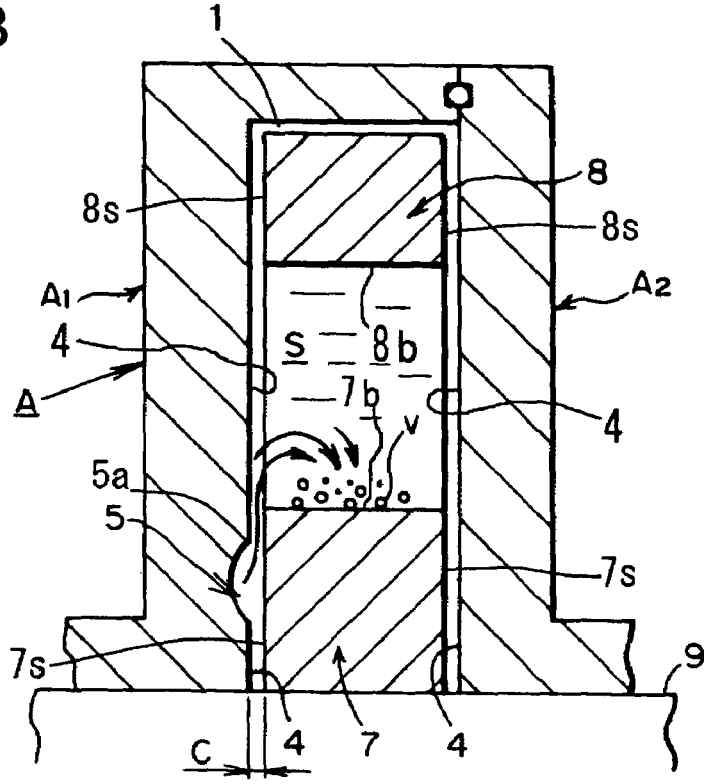
FIG. 6B is a major component longitudinal side cross-section view showing the condition where the pressure is gradually increasing because of the fluid flowing into the cell and where the vapor bubbles are shrinking.

Next, the process where the negative pressure of the fluid smoothly increases as the cell S moves along the transfer side partition part 4 from the intake port 2 side to the discharge port 3 side, will be described based on FIG. 5 and FIG. 6. First, a suitable cell S reaches the transfer side partition part 4 and a closed condition is created when both side surfaces of the cell S are enclosed by both transfer side partition parts 4, lowering the pressure than that of the fluid on the discharge port side 3. The internal fluid becomes negatively pressured, so vapor bubbles v occur because of cavitation and collect at the gear bottom parts 7*b* of the inner rotor 7 which forms the cell S (Refer to FIG. 5A and FIG. 6A). The fluid pressure inside the cell S is negative, so the fluid in the shallow groove 5 will enter the cell S through the side clearance C (Refer to FIG. 5B). Furthermore, as the cell S moves to the discharge port 3 side, the fluid pressure in the cell S which was negative will gradually rise, and the vapor bubbles v will gradually shrink and be eliminated without abruptly collapsing (destructing) (Refer to FIG. 5C and FIG. 6B).

Figure 8:
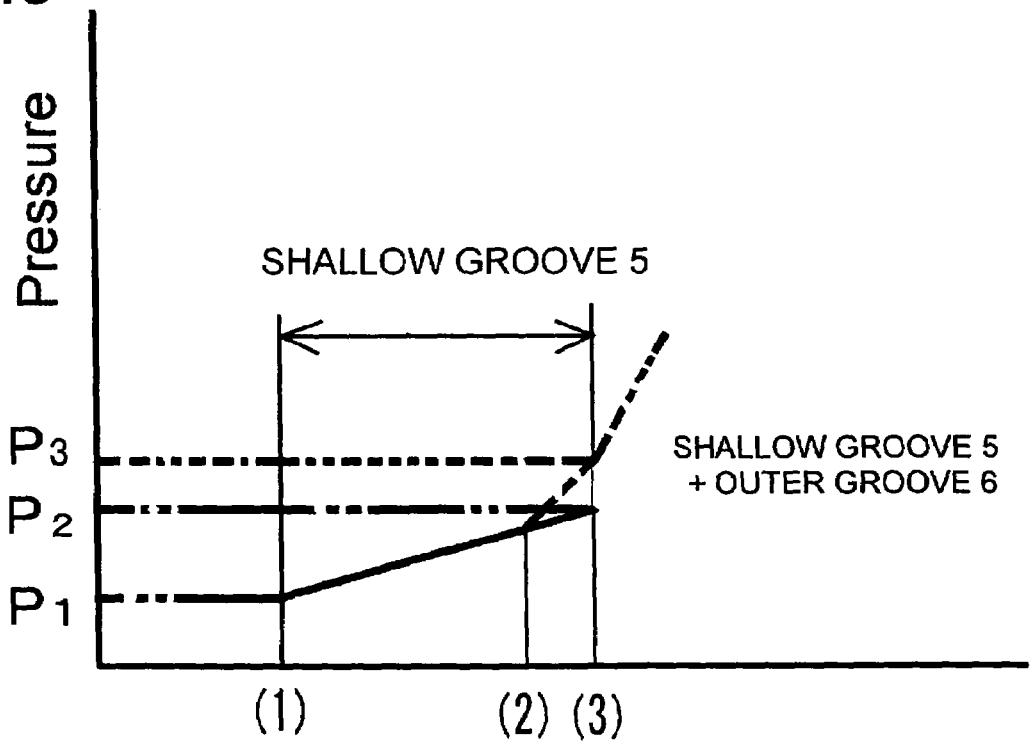
FIG. 8 is a graph showing the pump characteristics of the present invention.

Next, the aforementioned process will be described using the graph of FIG. 8. First, point (1) on the graph represents the point with negative pressure PI where both sides of the cell S are closed by the transfer side partition part 4. At point (1), the shallow groove 5 and the cell S are communicated through the side clearance C, and fluid gradually flows into the cell S from the shallow groove 5 through the side clearance C, and the pressure of the fluid in the cell S smoothly rises up to an appropriate pressure $P_2$ (Refer to the gradually rising bold line).

Next, point (3) represents the location where the cell S which had been closed by the transfer side partition part 4 becomes communicated with the outer shallow groove 6, and the vapor bubbles v are gradually reduced (without abruptly collapsing (destructing)) because of the smooth pressure rise (between points (1) and (3)), and the collapsing force (impact of destruction) of the vapor bubbles v created by cavitation can be reduced. Incidentally, a plurality of vapor bubbles v which have collected around the gear bottom parts of the inner rotor 7 are eliminated in between points (1) and (3).

The dotted line in the figure represents the pressure change attributed to the shallow groove 5 and the outer shallow groove 6. At point (2), the cell S which is communicated with the shallow groove 5 through the side clearance C at the transfer side partition part 4 becomes communicated with the outer shallow groove 6 through the side clearance C as the cell S approaches the outer shallow groove 6. At this time, the cell S will be communicated with the outer shallow groove 6 after the fluid pressure in the cell S has been gradually increased because of the shallow groove 5, and therefore the cell S can be communicated with the outer shallow groove 6 without an abrupt pressure change ($P_3$) at point (3).

The present invention provides a shallow groove 5 in order to relieve an abrupt rise in fluid pressure, prevents cavitation collapse (destruction), and can increase the durability of the pump. With the present invention, vapor bubbles v caused by cavitation can be eliminated even by using only the shallow groove 5. Furthermore, by using the shallow groove 5 together with an outer shallow groove 6, vapor bubbles v which occur in the fluid inside the cell S can more positively be eliminated.

Incidentally, the outer shallow groove 6 is preferably formed in the transfer side partition part 4 to intersect with the gear bottom parts of the outer rotor 8, and is preferably formed as far to the outside as possible from the location of the gear bottom parts of the inner rotor 7, or in other words the circular locus Q. Furthermore, when the cell S is communicated with the outer shallow groove 6, replenishing of fluid from the shallow groove 5 is not necessary, so the shallow groove 5 is not required to be in a position close to the gear bottom circle of the inner rotor 7 in the transport path of the cell S.

Figure 7A:
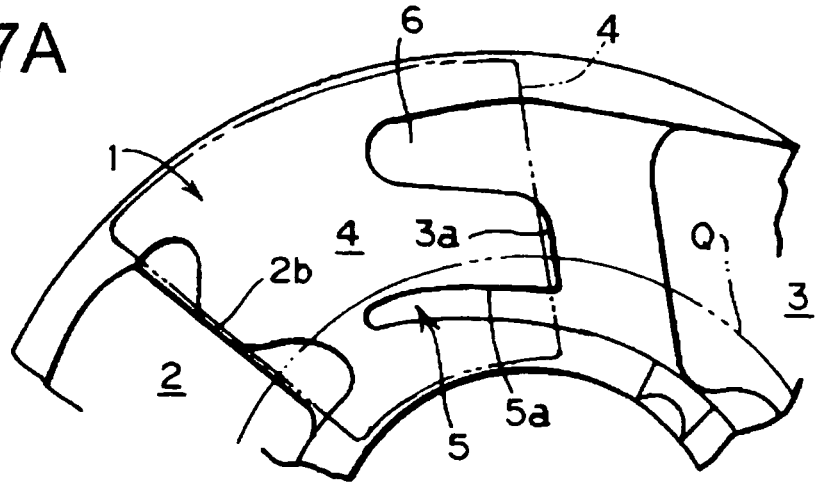
FIG. 7A is a top view diagram of an embodiment wherein the shallow groove moves away from the circular locus when approaching the leading edge of the discharge port.
Figure 7B:
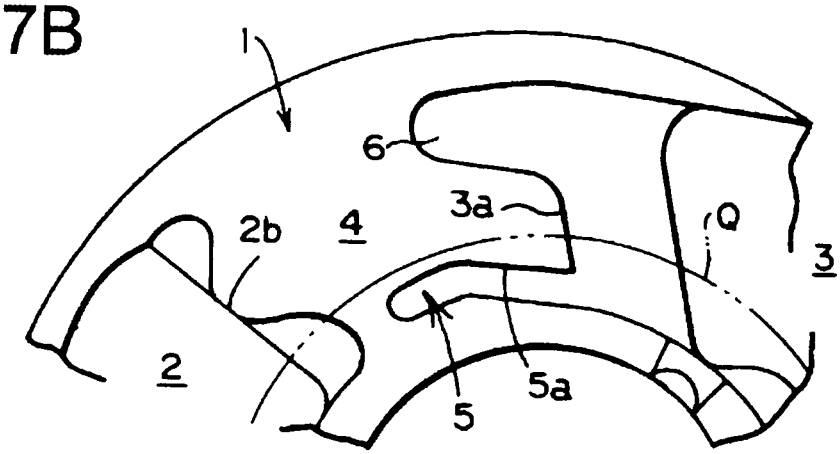
FIG. 7B is a top view diagram of an embodiment wherein the shallow groove moves away from the circular locus when approaching the leading edge of the discharge port and the region which moves away is linear.
Figure 7C:
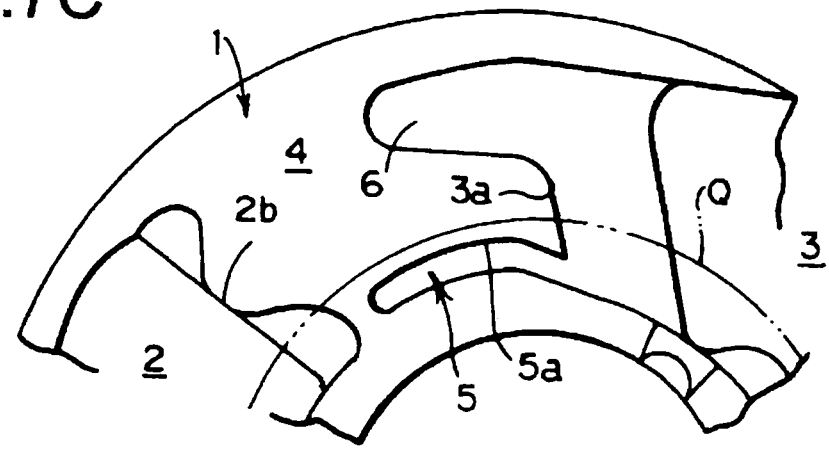
FIG. 7C is a top view diagram of an embodiment wherein the shallow groove moves away from the circular locus when approaching the leading edge of the discharge port and the region which moves away is shortened.

If the fluid is discharged by the outer shallow groove 6, the shape of the shallow groove 5 may be as shown below. First FIG. 7A shows an embodiment where the shallow groove 5 gradually separates from the circular locus Q when approaching the leading edge 3*a* of the discharge port 3. FIG. 7B shows an embodiment where the shallow groove 5 moves away from the circular locus Q as the shallow groove 5 approaches the leading edge 3*a* of the discharge port 3 and the region which is moving away is linear. FIG. 7C shows an embodiment where the shallow groove 5 moves away from the circular locus Q as the shallow groove 5 approaches the leading edge 3*a* of the discharge port 3, and particularly the region which is moving away is shortened.

Furthermore, with the present invention, the transfer side partition part 4 was disclosed to be located at a lagging angle, but this is not an absolute restriction. Furthermore, the shallow groove 5 is communicated with the cell S through the side clearance C when the cell S is closed by the transfer side partition part 4, but the invention also includes the case where the cell S is communicated with the shallow groove 5 when the cell S is at the maximum partitioned volume.

A comparison of the present invention and conventional technology is shown in FIG. 10 and FIG. 11. FIG. 10 shows the present invention, and FIG. 11 shows the conventional technology. With the present invention, as shown in FIG. 10A, the cell S and the shallow groove 5 do not intersect. On the other hand, with the conventional technology, as shown in FIG. 11A, the inside of the cell and the shallow groove do intersect and are directly communicated. Furthermore, with the present invention, as shown in FIG. 10B, the inside of the cell S is communicated with the shallow groove 5 through the side clearance C, so the pressurized fluid from the discharge port 3 will gradually flow from the shallow groove 5 through the side clearance C in with the internal fluid at negative pressure.

Furthermore, the negative pressure of the internal fluid (−P) will gradually and smoothly change to become positive pressure (+P). Therefore, as shown in FIG. 10C, the vapor bubbles v will gradually become pressurized by the surrounding fluid, and will eventually disappear. With the conventional technology, as shown in FIG. 11B, a local pressure change will occur the moment the cell intersects with the shallow groove, and the negative pressure (−P) of the internal fluid will abruptly change to positive pressure (+P).

Therefore, as shown in FIG. 11C, the vapor bubbles v will abruptly be pressurized by the fluid and will collapse (destruct), and this impact will create erosion which causes impact scarring on the rotors and the inside of the housing. In this manner, the present invention can prevent erosion by gradually eliminating the vapor bubbles v formed because of cavitation, but the conventional technology can not prevent erosion from occurring.

What is claimed is:

1. An oil pump, comprising:

an inner rotor;

an outer rotor which rotates with the inner rotor while forming a cell;

an intake port;

a discharge port;

a transfer side partition part formed between the terminal end of the intake port and the leading end of the discharge port;

a side clearance established between the transfer side partitioned part and the rotor side surface of the inner rotor and the outer rotor; and a shallow groove which is formed only in the transfer side partition part, and which is communicated with the leading end of the discharge port but not communicated with the intake port, wherein an outer edge in a width direction of the shallow groove does not intersect with the cell on the transfer side partition part that is closed from the intake port and the discharge port, and is proximal to a circular locus the inner rotor gear bottom part configuring the cell, and is positioned toward the inside of the circular locus of the gear bottom parts of the inner rotor, wherein a side clearance is formed by bringing in proximity the shallow groove to the inner rotor gear bottom parts that configure the cell closed to the intake port and the discharge port on the transfer side partition part, while allowing communication between the shallow groove and the inner rotor near bottoms parts, and wherein fluid in the discharge port is transferred into the cell through the side clearance that allows communication established between the shallow groove and the inner rotor gear bottom parts.

2. The oil pump according to claim 1, wherein a gap of approximately 1 mm or less is established between the outside edge of the shallow groove in the groove width direction and the circular locus of the gear bottom parts formed by the rotation of the inner rotor.

3. The oil pump according to claim 1, wherein, in the transport side partition part, an outer shallow groove is formed farther to the outside, from the center of rotation of the inner rotor, than the location where the shallow groove is formed, with the outer shallow groove communicating with the discharge port while not communicating with the intake port, and wherein the outer shallow groove intersects and communicate with the cell.

4. The oil pump according to claim 3, wherein the length of the outer shallow groove in the longitudinal direction is formed to be shorter than that of the shallow groove.

5. The oil pump according to claim 1, wherein the transport side partition part in which the shallow groove is formed is established on both sides of the inner rotor and the outer rotor.

6. The oil pump according to claim 2, wherein, in the transport side partition part, an outer shallow groove is formed farther to the outside, from the center of rotation of the inner rotor, than the location where the shallow groove is formed, with the outer shallow groove communicating with the discharge port while not communication with the intake port, and wherein the outer shallow groove intersects and communication with the cell.

7. The oil pump according to claim 2, wherein the transport side partition part in which the shallow groove is formed is established on both sides of the inner rotor and the outer rotor.

8. The oil pump according to claim 3, wherein the transport side partition part in which the shallow groove is formed is establish on both sides of the inner rotor and the outer rotor.

9. The oil pump according to claim 4, wherein the transport side partition part in which the shallow groove is formed is established on both sides of the inner rotor and the outer rotor.

* * * * *